US008279135B2

(12) United States Patent
Wither et al.

(10) Patent No.: US 8,279,135 B2
(45) **Date of Patent: *Oct. 2, 2012**

(54) DIELECTRICALLY-LOADED ANTENNA

(75) Inventors: David Michael Wither, Northampton (GB); Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/584,663

(22) Filed: Sep. 9, 2009

(65) Prior Publication Data

US 2010/0001920 A1 Jan. 7, 2010

Related U.S. Application Data

(63) Continuation of application No. 11/060,215, filed on Feb. 17, 2005.

(30) Foreign Application Priority Data

Nov. 11, 2004 (GB) ..... 0424980.1

(51) Int. Cl.
*H01Q 1/36* (2006.01)

(52) U.S. Cl. ..... 343/895

(58) Field of Classification Search ..... 343/895, 343/821, 702, 850, 859, 860, 905, 906
See application file for complete search history.

(56) References Cited

U.S. PATENT DOCUMENTS

| | | | | |
|---|---|---|---|---|
| 4,697,192 A | | 9/1987 | Hofer et al. | |
| 5,349,365 A | | 9/1994 | Ow et al. | |
| 5,706,019 A | | 1/1998 | Darden, IV et al. | |
| 5,854,608 A | * | 12/1998 | Leisten | 343/895 |
| 5,859,621 A | | 1/1999 | Leisten | |
| 5,920,292 A | * | 7/1999 | O'Neill, Jr. | 343/895 |
| 6,094,178 A | * | 7/2000 | Sanford | 343/895 |
| 6,150,994 A | * | 11/2000 | Winter et al. | 343/895 |
| 7,245,268 B2 | * | 7/2007 | O'Neill et al. | 343/895 |
| 7,602,350 B2 | * | 10/2009 | Leisten | 343/895 |

FOREIGN PATENT DOCUMENTS

| | | |
|---|---|---|
| DE | 2642013 | 5/1977 |
| DE | 3612534 A1 | 11/1986 |
| GB | 2309592 | 7/1997 |
| GB | 2309592 A | 7/1997 |

(Continued)

OTHER PUBLICATIONS

Official search report from GB0422179.2, Feb. 14, 2005.

(Continued)

*Primary Examiner* — Michael C Wimer

(74) *Attorney, Agent, or Firm* — John Bruckner, PC

(57) ABSTRACT

A dielectrically loaded backfire helical antenna has a cylindrical ceramic core and a feed structure which passes axially through the core to a distal end face of the core where it is connected to helical conductors located on the outside of the core. Opening out on the proximal end face of the core is a cavity which is coaxial with the feed structure. A conductive balun layer encircling a portion of the core extends over the proximal end face of the core and the wall of the cavity to connect the helical elements to the feeder structure when it emerges into the cavity. The presence of the cavity and accommodating some of the length of the balun in the cavity allows a reduction in the size and weight of a dielectrically loaded backfire antenna.

22 Claims, 3 Drawing Sheets

FOREIGN PATENT DOCUMENTS

| | | | |
|---|---|---|---|
| GB | 2317057 | | 3/1998 |
| GB | 2367429 | A | 4/2002 |
| WO | WO 00/48268 | | 8/2000 |
| WO | WO 00/59070 | | 10/2000 |
| WO | WO 2006/037990 | A1 | 4/2006 |

OTHER PUBLICATIONS

Official search report from GB0424980.1, Mar. 7, 2005.

International search report from PCT/GB2005/004034, Nov. 30, 2005.

* cited by examiner

DIELECTRICALLY-LOADED ANTENNA

CROSS-REFERENCE TO RELATED APPLICATION

This application is a continuation of and claims a benefit of priority under 35 U.S.C. 120 from copending utility patent application U.S. Ser. No. 11/060,215, filed Feb. 17, 2005 which in-turn related to, and claims a benefit of priority under one or more of 35 U.S.C. 119(a)-119(d) from copending foreign patent application United Kingdom 0424980.1, filed Nov. 11, 2004, the entire contents of which are hereby expressly incorporated herein by reference for all purposes.

FIELD OF THE INVENTION

This invention relates to an antenna for operation at frequencies in excess of 200 MHz, and particularly but not exclusively to an antenna having helical elements on or adjacent the surface of a solid dielectric core.

BACKGROUND OF THE INVENTION

Such an antenna is disclosed in numerous patent publications of the assignee, including U.S. Pat. Nos. 5,854,608, 5,945,963 and 5,859,621. These patents disclose antennas each having one or two pairs of diametrically opposed helical antenna elements which are plated on a substantially cylindrical electrically insulative core of a material having a relative dielectric constant greater than 5, with the material of the core occupying the major part of the volume defined by the core outer surface. A feed structure extends axially through the core, and a trap in the form of a conductive sleeve encircles part of the core and connects to the feed structure at one end of the core. At the other end of the core, the antenna elements are each connected to the feed structure. Each of the antenna elements terminates on the rim of the sleeve and each follows a respective longitudinally extending path. In the antenna disclosed in the assignee's U.S. Pat. No. 6,369,776, the feed structure, which is a coaxial transmission line, is housed in an axial passage through the core, the diameter of which passage is greater than the outer diameter of the coaxial line. The outer shield conductor of the coaxial line is thereby spaced from the wall of the passage. In practice, the coaxial line is surrounded by a plastics tube which fills the space between the outer shield conductor and the wall of the passage and has a relative dielectric constant between that of air and that of the material of the core.

The conductive sleeve referred to above is coupled to the outer shield of the feed structure where it emerges at a proximal end face of the antenna to form a balun at the frequencies of certain modes of resonance of the antenna. This effect occurs when the electrical length of the sleeve and its connection to the feed structure (with respect to currents on the inner surface of the sleeve) is $n\lambda_g/4$ where $\lambda_g$ is the guide wavelength of the relevant resonance.

Dielectrically-loaded antennas such as those described above can be used for the reception of circularly polarised signals transmitted by satellites, such as GPS navigation signals, satellite telephone signals and broadcast signals. The antennas also have applications in the field of mobile telephones, e.g. cellular telephones, and well as wireless local area networks.

SUMMARY OF THE INVENTION

According to a first aspect of the invention, antenna size and weight can be reduced by providing a dielectrically-loaded antenna for operation at a frequency in excess of 200 MHz, which comprises a dielectric core of a solid material having a relative dielectric constant greater than 5, an antenna element structure disposed on or adjacent the outer surface of the core, and, coupled to the antenna element structure, a feed structure extending through a passage in the core between a distal surface portion of the core and an oppositely directed proximal surface portion of the core. The core has a cavity the base of which forms the said proximal surface portion. The cavity is preferably cylindrical, with a central axis which also constitutes an axis of the feed structure. Typically, the axial depth of the cavity is between 10% and 50% of the outer axial extent of the core and the average width of the cavity, measured through the axis, is between 20% and 80% of the average width of the core measured in the same plane lying perpendicularly to the axis.

Preferably, the antenna element structure comprises a plurality of elongate antenna elements extending from connections with the feed structure at or adjacent the distal end of the passage through the core, and over laterally directed side surface portions of the core, to connections with a linking element in the form of an outer conductive layer extending around the core, which layer extends from the said connections to an inner conductive layer on the wall of the cavity, the inner conductive layer being connected to the feed structure at or adjacent the other end of the passage through the core. The feed structure in the preferred antenna in accordance with the invention is a coaxial transmission line, and the outer conductive layer comprises a conductive sleeve. When the core is cylindrical and has proximal and distal end faces, the cylindrical cavity may share a common axis with the feed structure. The outer conductive layer may comprise not only the conductive sleeve encircling the core, but also a proximal conductive layer portion covering the proximal end face of the core. The inner wall of the cavity then has a conductive covering connected to the outer conductive layer and to the shield conductor of the coaxial feed structure in the region of the base of the cavity.

It will be appreciated that, in this case, a balun is formed when the electrical length of the inside surfaces (i.e. the surfaces adjoining the dielectric material of the core) of the plating on the cavity base, the inner wall of the cavity, the proximal end face of the core and that forming the sleeve is equal to or in the range of $n\lambda_g/4$, when measured in a plane containing the central axis. This means that the longitudinal depth of the sleeve, i.e. the depth of the sleeve parallel to the axis, is significantly shorter than that of the sleeve of an antenna without the cavity and operating at the same frequency. The axial length of the core may, therefore, be smaller than in prior antennas which, in turn, means that the antenna can be made lighter.

The plated inner wall of the cavity can form part of an outer feed structure connecting the antenna to radio frequency (r.f.) receiving or transmitting circuitry, the diameter of the cavity being suitable for forming part of a coaxial transmission line having a higher characteristic impedance (e.g. 50 ohms) than the characteristic impedance of a coaxial line inside the core. Accordingly, the cavity may provide a convenient means for mounting and connecting the antenna to r.f. receiving or transmitting circuitry, the feed structure within the core, by virtue of its characteristic impedance being between that of the r.f. circuitry and the radiation resistance of the antenna, acting as a quarter wave impedance transforming section.

The space provided by the cavity may also be used to house an impedance or reactance matching structure, such as a short-circuited stub, e.g. using plated tracks on a washer seated on the base of the cavity.

According to a second aspect of the invention, a dielectrically-loaded antenna for operation at a frequency in excess of 200 MHz comprises a dielectric core of a solid material having a relative dielectric constant greater than 5, an antenna element structure disposed on or adjacent an outer surface of the core, a feed structure extending through a passage in the core from a distal surface of the core, where it is coupled to the antenna element structure, to an oppositely directed surface of the core, and a balun in the form of a conductive layer which overlies a proximal outer surface portion of the core. The core has a proximally directed cavity, the passage terminating inside the cavity, and the balun layer extends into the cavity where it is connected to the feed structure. The core may have a side surface, a distal end surface, a proximal end surface and a central axis, with the feed structure lying on the axis and the cavity centred on the axis. The balun layer may have an outer portion of the side surface, an end portion on the proximal end surface, and an inner portion on an inwardly directly surface of the cavity. In the case of the core being cylindrical, the cavity is preferably cylindrical, and both the outer portion and the inner portion of the balun layer are annular.

The invention will be described below by way of example with reference to the drawings.

DETAILED DESCRIPTION OF THE PREFERRED EMBODIMENTS OF THE INVENTION

Figure 1:
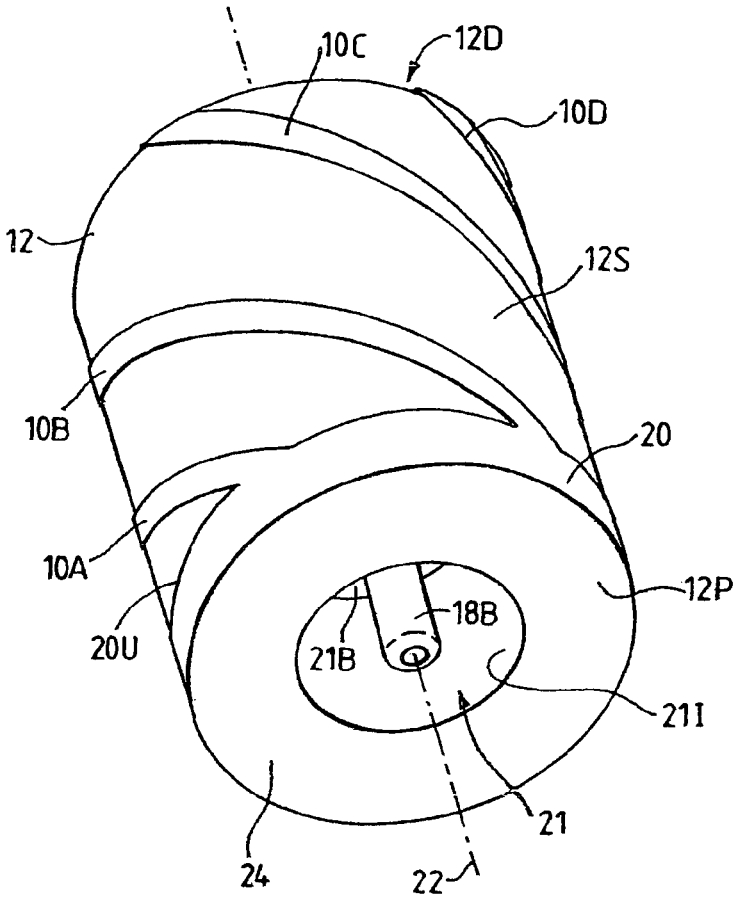
FIG. 1 is an isometric lower view of a dielectrically-loaded quadrifilar antenna in accordance with the invention.
Figure 2:
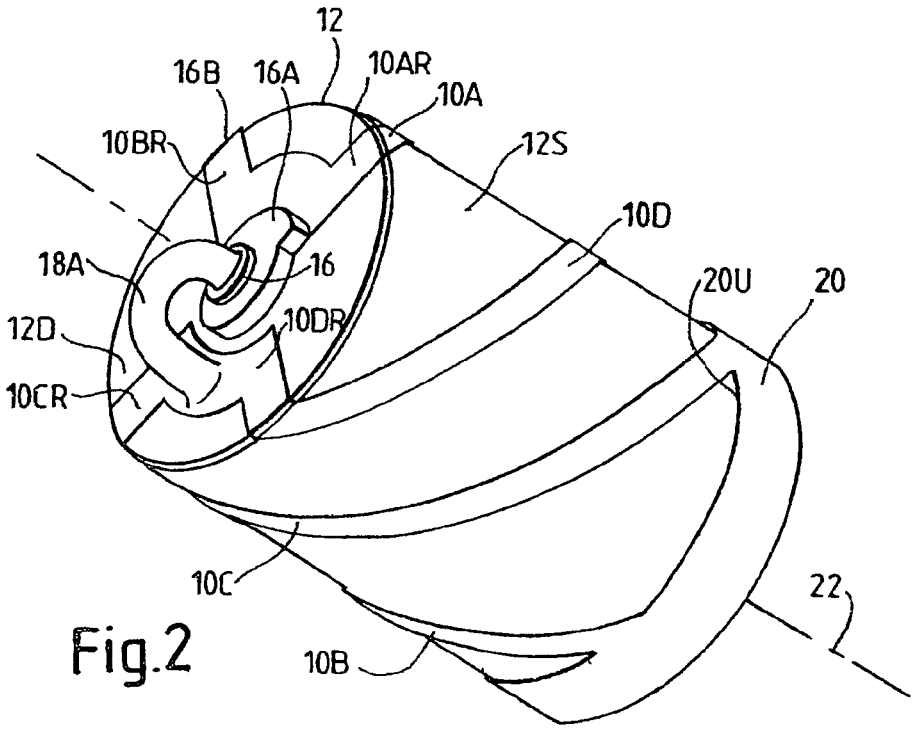
FIG. 2 is a isometric upper view of the antenna of FIG. 1.
Figure 3:
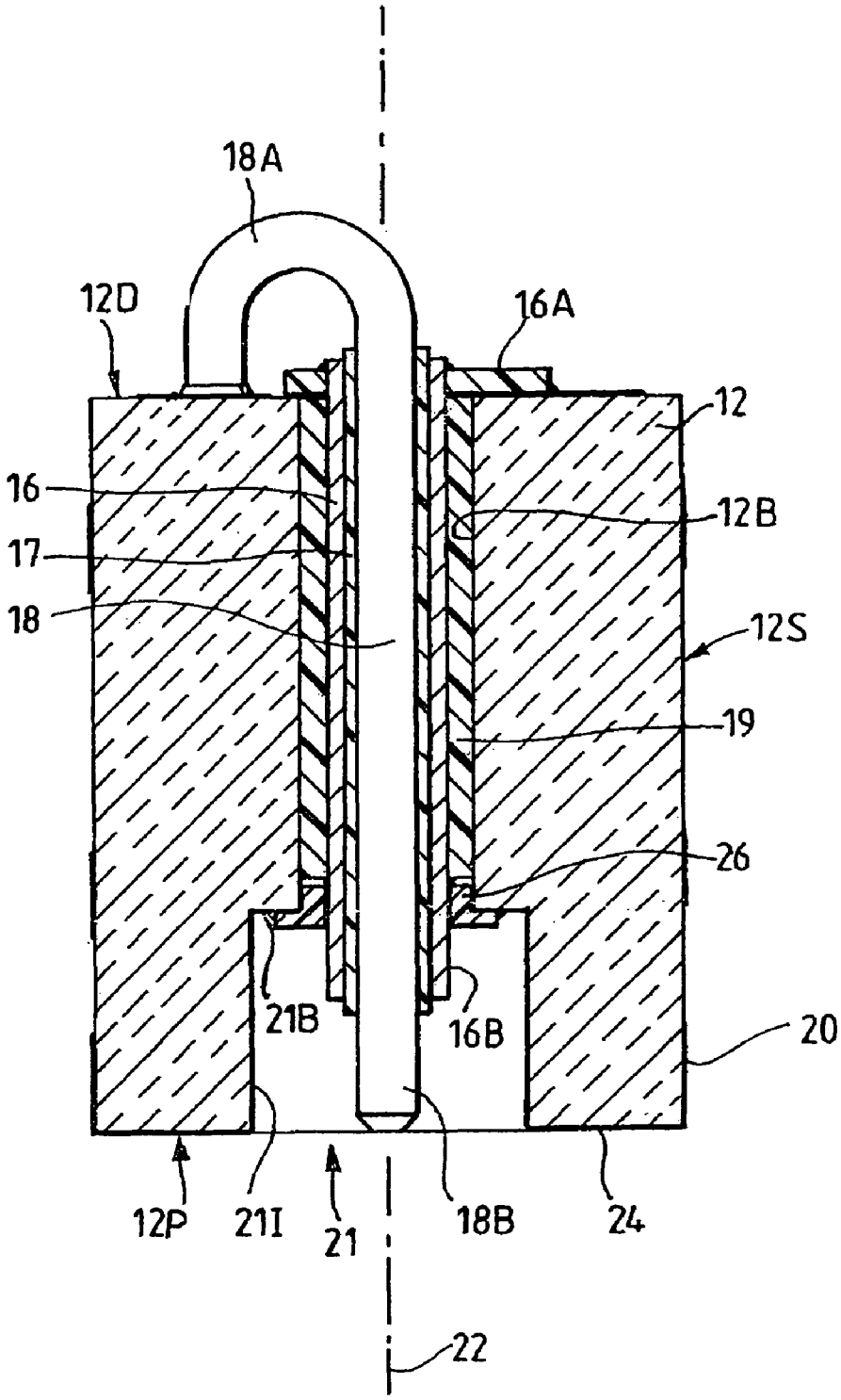
FIG. 3 is an axial cross section of the antenna shown in FIGS. 1 and 2.

Referring to FIGS. 1 to 3, a dielectrically-loaded antenna in accordance with the invention has an antenna element structure with four axially co-extensive helical tracks 10A, 10B, 10C and 10D plated on the cylindrical outer side surface 12S of a cylindrical ceramic core 12.

The core has an axial passage in the form of a bore 12B extending through the core 12 from a distal end face 12D to a proximal end face 12P. Housed within the bore 12B is a coaxial feed structure having a conductive tubular outer shield 16, an insulating layer 17 and an elongate inner conductor 18 insulated from the shield by the insulating layer 17. Surrounding the shield is a dielectric insulative sleeve 19 formed as a tube of plastics material of predetermined relative dielectric constant the value of which is less than the relative dielectric constant of the material of the ceramic core 12.

The combination of the shield 16, inner conductor 18 and insulative layer 17 constitutes a coaxial transmission line of predetermined characteristic impedance passing through the antenna core 12 for connecting the distal ends of the antenna elements 10A to 10D to radio frequency (r.f.) circuitry of equipment to which the antenna is to be connected. Connections between the antenna elements 10A to 10D and the feed structure are made via conductive connection portions associated with the helical tracks 10A to 10D, these connection portions being formed as radial tracks 10AR, 10BR, 10CR, 10DR (FIG. 2) plated on the distal end face 12D of the core 12 each extending from a distal end of the respective helical track to a location adjacent the end of the bore 12B. The shield 16 is conductively bonded to a connection portion which includes the radial tracks 10A, 10B, whilst the inner conductor 18 is conductively bonded to the connection portion which includes the radial tracks 10C and 10D.

The other ends of the antenna elements 10A to 10D are connected to a common virtual ground conductor 20 in the form of a plated sleeve surrounding a proximal end portion of the core 12. This sleeve 20 is, in turn, connected to the shield conductor 16 of the feed structure in a manner to be described below.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. Where antenna elements 10A and 10C are connected to the sleeve 20, the rim 20U is a little further from proximal face 12P than where the antenna elements 10B and 10D are connected to the sleeve 20.

In accordance with the invention, the core 12 has a proximally directed cavity 21 which opens out on the proximal end face 12P of the core. This cavity 21 is cylindrical and, in the embodiment shown, has an axis which is coincident with the central axis 22 of the core. Both the cylindrical inner wall 21I and the planar base 21B of the cavity 21 are plated with a conductive layer which is electrically connected to the outer shield 16 of the feed structure passing through the core. The proximal end 12P is also plated over the whole of its surface to form a proximal plating 24. The sleeve 20, the plating 24, the plated layer on the inner wall 21I and base 21B of the cavity 21, together with the outer shield 16 of the feed structure, form a balun which provides common mode isolation of the antenna element structure from the equipment to which the antenna is connected when installed. In an axial plane, the electrical length of the combination of the sleeve 20, the proximal end surface plating 24, the plating on the inner wall 21I and base 21B of the cavity 21 is $n\lambda_g/4$ where $n\lambda_g$ is the guide wavelength on the core side of the conductive layer portions in question.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18 and the elements 10A, 10B connected to the shield conductor 16, the sleeve 20 and plating 24 acting as a trap preventing the flow of currents from the antenna elements 10A to 10D to the outer shield 16 at the base 21B of the cavity 21. Operation of quadrifilar dielectrically loaded antennas having a balun on the core is described in more detail in U.S. Pat. Nos. 5,854,608 and 5,859,621, the entire disclosures of which are incorporated in this application so as to form part of the subject matter of this application as filed.

The feed structure performs functions other than simply conveying signals to or from the antenna element structure. Firstly, as described above, the shield 16 acts in combination with the balun layer 20 to provide common-mode isolation at the point of connection of the feed structure to the antenna element structure. The length of the shield conductor between its connection with the plating on the base of the cavity 21 and its connection to the antenna element connection portions 10AR, 10BR, together with the dimensions of the bore 12B and the dielectric constant of the material filling the space between the shield 16 and the wall of the bore are such that the electrical length of the shield 16 is, at least approximately, a quarter wavelength at the frequency of the required mode of resonance of the antenna, so that the combination of the balun layer 20, 24, 21I, 21B and the shield 16 promotes balanced currents at the connection of the feed structure to the antenna element structure.

Secondly, the feed structure serves as an impedance transformation element transforming the source impedance of the antenna (typically 5 ohms or less), to a required load impedance presented by the equipment to which the antenna is to be connected, typically 50 ohms. The transformation properties of the feed structure are a function of its characteristic impedance and length. A reactive impedance match is achieved by including additionally, a reactance element such as a grounded stub (not shown) in the equipment to which the antenna is connected, the stub being connected to a projecting portion 18B of the inner conductor 18.

Typically, the relative dielectric constant of the insulating layer 17 is between 2 and 5. One suitable material, PTFE, has a relative dielectric constant of 2.2.

The outer insulative sleeve 19 of the feed structure reduces the effect of the ceramic core material on the electrical length of the outer shield 16 of the feed structure within the core 12. Selection of the thickness of the insulative sleeve 19 and/or its dielectric constant allows the location of balanced currents from the feed structure to be optimised. The outer diameter of the insulative sleeve 19 is equal to or slightly less than the inner diameter of the bore 12B in the core 12 and extends over at least the majority of the length of the feed structure. The relative dielectric constant of the material of the sleeve 19 is less than half of that of the core material and is typically of the order of 2 or 3. Preferably, the material falls within a class of thermoplastics materials capable of resisting soldering temperatures as well as having sufficiently low viscosity during moulding to form a tube with a wall thickness in the region of 0.5 mm. One such material is PEI (polyetherimide). This material is available from GE Plastics under the trade mark ULTEM. Polycarbonate is an alternative material.

The preferred wall thickness of the sleeve 19 is 0.45 mm, but other thicknesses may be used, depending on such factors as the diameter of the ceramic core 12 and the limitations of the moulding process. In order that the ceramic core has a significant effect on the electrical characteristics of the antenna and, particularly, yields an antenna of small size, the wall thickness of the insulative sleeve 19 should be no greater than the thickness of the solid core 12 between its inner bore 12B and its outer surface. Indeed, the sleeve wall thickness should be less than one half of the core thickness, preferably less than 20% of the core thickness.

As explained above, by creating a region surrounding the shield 16 of the feed structure of lower dielectric constant than the dielectric constant of the core 12, the effect of the core 12 on the electrical length of the shield 16 and, therefore, on any longitudinal resonance associated with the outside of the shield 16, is substantially diminished. By arranging for the insulative sleeve 19 to be close fitting around the shield 16 and in the bore 12B, consistency and stability of tuning is achieved. Since the mode of resonance associated with the required operating frequency is characterised by voltage dipoles extending diametrically, i.e. transversely of the cylindrical core axis, the effect of the insulative sleeve 19 on the required mode of resonance is relatively small due to the sleeve thickness being, at least in the preferred embodiment, considerably less than that of the core. It is, therefore, possible to cause the linear mode of resonance associated with the shield 16 to be decoupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing.

The base 21B of the cavity 21 forms a proximal surface portion of the core 12 which is oppositely directed with respect to the distal surface 12D. The core 12B, being coaxial with the cylindrical outer surface 12S of the core 12 and the cylindrical cavity 21, emerges centrally in the cavity base 21B, as seen most clearly in FIG. 3. The insulating sleeve 19 terminates short of the base 21B, while the shield 16 of the feed structure has a projecting portion 16B which projects a short distance into the cavity 21. The inner conductor 18 of the feed structure projects axially into the cavity by a greater distance to allow connection to a transmission line associated with the equipment in which the antenna is to be installed. Thus, the projecting portion 18B of the inner conductor 18 acts as a connecting pin which, typically, is received in a resilient tubular socket connected to the r.f. receiving or transmitting circuitry of the equipment. Connection to the shield 16 of the feed structure may be made by means of a spring-loaded bush, a crimped bush or soldered bush (not shown) which may form part of a connecting coaxial line and which also effects an annular connection between the projecting portion 16B of the shield 16 and the plated surfaces of the cavity. Typically, the dimensions of the bush and the screen to which it is connected, in combination with those of the projecting portion 18B of the inner conductor 18, as well as those of the socket receiving the projecting inner conductor portion 18B, are such that the characteristic impedance of the line extending proximally of the antenna to the above-mentioned r.f. circuitry is in the region of 50 ohms. Impedance transformation from this impedance to the source or load impedance presented by the antenna elements at the distal face of the antenna is effected by the feed structure 16, 17, 18 as described above, and the above-mentioned reactance element.

Typically, the diameter of the cavity 21 is about half the outer diameter of the core 12, i.e. about 5 mms in the case of an antenna operable at 1575 MHz (for GPS signal reception). The depth of the cavity is typically in the range of from one fifth to one third of the axial extent of the core 12. In the example illustrated in FIGS. 1 to 3, the depth of the cavity is about one quarter of the axial length of the core which equates to a depth of 3.8 mms in the GPS antenna.

Referring again to the balun produced by the combination of the plated cavity base 21B, the plated inner surface of the cavity 21I, the plated core proximal end face 12P and the sleeve 20, it will be understood that because (in comparison with the positioning of the equivalent conductors of the prior antennas referred to above, i.e. the proximal end surface plating and the conductive sleeve of those antennas) the major part of the length (in an axial plane) of these conductive elements is on an end face of the core or between the extremities of the core in the axial direction, the axial extent of the sleeve 20 can be considerably less than on the prior art antennas. This has the effect of shortening the core. This shortening of the core and the reduction in core material volume resulting from the presence of the cavity yields a significant reduction in the weight of the core.

Figure 4:
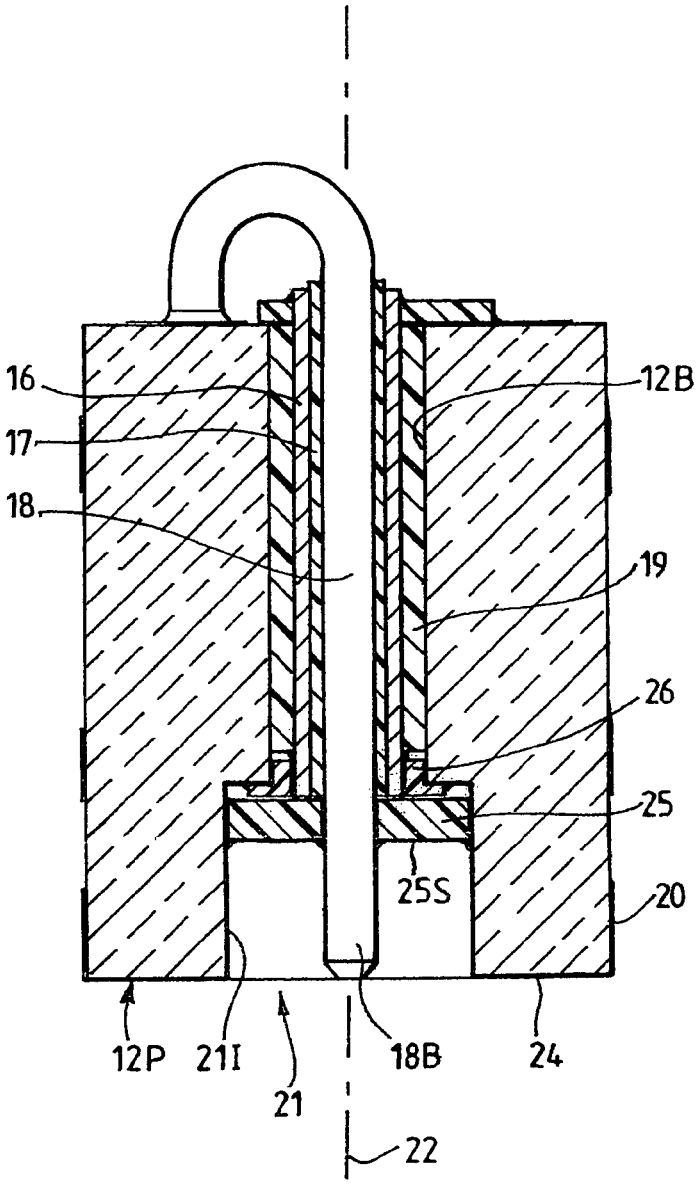
FIG. 4 is an axial cross section of an alternative antenna in accordance with the invention.
Figure 5:
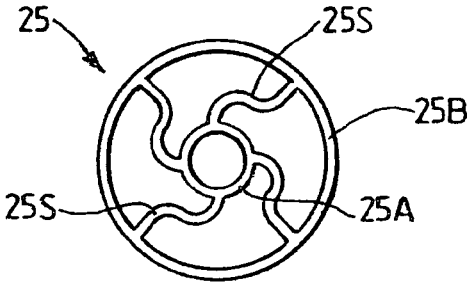
FIG. 5 is a plan view of a reactance matching element of the antenna shown in FIG. 4.

Referring to FIGS. 4 and 5, reactive matching may be incorporated in an antenna itself in accordance with the invention by connecting the projecting portion 18B of the inner conductor 18 of the feed structure to a grounding conductor at a location on the projecting portion 18B spaced from the connection of the outer shield 16 of the feed structure to the cavity plating (in this case the plating on the cavity base 21B). This is achieved by means of a reactance element in the form of at least one stub conductor 25S on the proximal surface of a board and/or an insulative annulus (washer) 25 located proximally of a conductive bush 26 and closely encircling the projecting portions 18B of the feed structure inner conductor 18 adjacent the base 21B of the cavity 21.

As will be seen from FIG. 4, the washer 25 (typically made of PTFE) has an inner diameter matching the outer diameter of the projecting inner conductor portion 18B and an outer diameter matching the inner diameter of the cavity 21. The washer 25 may, therefore, be seated around the inner conductor projecting portion 18B with its distal face 25D (which is plated, abutting the conductive bush 26) connecting the shield 16 of the feed structure to the plated surface of the cavity base 21B. On the proximal surface of the washer there are two annular tracks 25A, 25B which are innterconnected by the stub conductors 25S. When the washer 25 is fitted in place in the cavity 21, the inner annulus 25A is soldered to the inner conductor projecting portion 18B and the outer annulus 25B is soldered to the plated cylindrical inner wall 21I of the cavity 21. The stub conductors 25S are meandered to provide a required electrical length, thereby creating a shunt inductance between the inner conductor projection portion 18B and the cylindrical cavity wall 21I to compensate for, in this example, the capacitive source impedance of the antenna.

In this alternative embodiment, the projecting inner conductor portion 18B again acts as a connecting portion for connection of the inner conductor 18 to r.f. circuitry of equipment which the antenna is to be installed, e.g. by means of a resilient tubular socket of predetermined dimensions. In this case, the plating on the inner wall 21I of the cavity may act as the shield of a coaxial transmission line connecting the antenna feed structure shield 16 to the equipment r.f. circuitry. Thus, a ferrule or annular conductor associated with the circuitry or with a line connected thereto, may be pushed into the cavity where it forms an electrical connection to the cavity inner wall plating, the dimensions of the ferrule and the socket receiving the inner conductor, together with the spacing between them, yielding a characteristic impedance of, typically, 50 ohms.

Connections between the bush 26, the shield 16 and the plated base 21B of the cavity may be made by applying a solder preform to the bush (e.g. in the form of a solder washer) during assembly of the antenna, the soldered connection being effected by passing the antenna through a reflow oven. Similarly, annular solder preforms matching the inner and outer diameter of the insulative washer 25 may be placed on the proximal surface of the washer 25 to effect connections between the stub conductors 25S and, respectively, the projecting inner conductor portion 18B and the plating on the inner surface 21I of the cavity 21.

The invention is not limited to use with quadrifilar antennas. The above mentioned British patents disclose, for example, loop antennas having application to reception and transmission of cellphone signals, amongst other uses. The size and weight of such antennas can be reduced in accordance with the invention. Reactive matching of the antenna element structure to the required load impedance presented by the equipment to which the antenna is to be connected may not be required and may be performed solely by the feed structure. The impedance transformation is brought about as a result of the feed structure having a characteristic transmission line impedance which lies between the source impedance at the connection to the antenna element structure and the required load impedance, and also as a result of the electrical length of the feed structure between the connection to the antenna element structure and the plating 24 being a quarter wavelength at the operating frequency of the antenna. Resistive impedance transformation takes place when the characteristic impedance of the feed structure is at least approximately the square root of the product of the source impedance and the load impedance.

What is claimed is:

1. A dielectrically loaded antenna for operation at a frequency in excess of 200 MHz, comprising: a dielectric core of a solid material having a relative dielectric constant greater than 5; an antenna element structure disposed on or adjacent the outer surface of the core; and a feed structure coupled to the antenna element structure and including at least one reactive matching element located on a board, wherein the antenna element structure is arranged to cause voltage dipoles to extend across the core, and wherein a primary plane of the board is oriented substantially perpendicularly to a central axis of the dielectric core.

2. The dielectrically loaded antenna according to claim 1, wherein the core has a proximal surface portion and a distal surface portion and the board is positioned on or adjacent said proximal surface portion.

3. The dielectrically loaded antenna according to claim 1, wherein the at least one reactive matching element is coupled to the antenna element structure.

4. The dielectrically loaded antenna according to claim 2, wherein the core is cylindrical and the board is circular.

5. The dielectrically loaded antenna according to claim 1, wherein said antenna is arranged such that substantially balanced currents exist at a connection between the feed structure and the antenna element structure.

6. The dielectrically loaded antenna according to claim 1, wherein the antenna element structure comprises a plurality of elongate antenna elements extending from connections with the feed structure, and over laterally directed surface portions of the core to connections with at least one conductive element extending circumferentially around the core.

7. The dielectrically loaded antenna according to claim 6, wherein the at least one circumferentially extending conductive element is positioned at or near an end of the core.

8. The dielectrically loaded antenna according to claim 6, wherein said antenna is a quadrifilar helical antenna comprising four axially co-extensive helical tracks.

9. The dielectrically loaded antenna according to claim 8, wherein said antenna is arranged to promote a phase difference in each helical element.

10. The dielectrically loaded antenna according to claim 9, wherein said antenna is sensitive to circularly polarised signals.

11. The dielectrically loaded antenna according to claim 1, further comprising a balun.

12. The dielectrically loaded antenna according to claim 11, wherein the balun is arranged to reduce the length of the dielectric core.

13. The dielectrically loaded antenna according to claim 11, wherein said balun provides common mode isolation of the antenna element structure from apparatus into which it is to be placed.

14. The dielectrically loaded antenna according to claim 1, further comprising an impedance transformation element.

15. The dielectrically loaded antenna according to claim 1, wherein the core has a cavity formed in the proximal surface portion.

16. The dielectrically loaded antenna according to claim 15, wherein the cavity lies on the central axis and the feed structure lies on the central axis.

17. The dielectrically loaded antenna according to claim 16, wherein the average width of the cavity, measured through the central axis, is between 20% and 80% of the average width of the core measured in a same plane lying perpendicularly to the central axis.

18. The dielectrically loaded antenna according to claim 1, comprising an impedance.

19. The dielectrically loaded antenna according to claim 18, wherein said impedance is reactive.

20. The dielectrically loaded antenna according to claim 19, wherein said reactive impedance is an inductance.

21. The dielectrically loaded antenna according to claim 20, wherein said reactive impedance is part of said feed structure and is coupled to a ground.

22. A quadrifilar dielectrically loaded antenna for operation at a frequency in excess of 200 MHz, comprising: a dielectric core of a solid material having a relative dielectric constant greater than 5 and having a proximal surface portion and a distal surface portion, an antenna element structure disposed on or adjacent the outer surface of the core and a feed structure coupled to the antenna element structure and including at least one reactive matching element located on a board, a primary plane of the board oriented substantially perpendicular to a central axis of the dielectric core and the board positioned on or adjacent said proximal surface portion, wherein the antenna element structure comprises a plurality of elongate antenna elements extending from connections with the feed structure, and over laterally directed surface portions of the core to connections with at least one conductive element arrangement extending circumferentially around the core.

* * * * *